United States Patent [19]

Kimura et al.

[11] Patent Number: 4,602,864

[45] Date of Patent: Jul. 29, 1986

[54] CLEANING DEVICE IN ELECTROSTATIC COPYING APPARATUS

[75] Inventors: Hiroshi Kimura, Habikino; Masahiko Hisajima; Kiyoshi Shibata, both of Osaka; Yoichiro Irie, Suita; Kiyoshi Morimoto, Osaka; Takashi Nagashima, Sakai; Yasuhiko Yoshikawa, Ikoma; Kiyonori Yamamoto, Neyagawa; Masahiro Watashi, Ikoma; Shinsuke Yoshinaga, Sakai; Toshihiko Yamamoto, Takaishi, all of Japan

[73] Assignee: Mita Industrial Co., Ltd., Japan

[21] Appl. No.: 480,173

[22] Filed: Mar. 29, 1983

[30] Foreign Application Priority Data

Apr. 20, 1982 [JP] Japan ..... 57-64665

[51] Int. Cl.[4] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 4,131,359 | 12/1978 | Honda | 355/15 |
| 4,253,761 | 3/1981 | Takizawa et al. | 355/15 |
| 4,279,501 | 7/1981 | Kojima et al. | 355/15 |
| 4,297,026 | 10/1981 | Honda et al. | 355/15 |
| 4,364,660 | 12/1982 | Oda | 355/15 |
| 4,396,276 | 8/1983 | Murasaki | 355/15 |
| 4,502,779 | 3/1985 | Kajita et al. | 355/15 |

*Primary Examiner*—Fred L. Braun

*Attorney, Agent, or Firm*—Beveridge, DeGrandi & Weilacher

[57] ABSTRACT

A cleaning device in an electrostatic copying apparatus, for removing residual toner particles from the surface of a photosensitive member adapted to move through an endless conveying passage, includes a blade holding mechanism mounted pivotally around an axis extending substantially parallel to the surface of the photosensitive member and substantially perpendicular to the moving direction of the photosensitive member, and a cleaning blade mounted on the blade holding mechanism. The cleaning device further includes a first spring elastically biasing the blade holding mechanism to a non-operating position in which the cleaning blade is away from the surface of the photosensitive member and an operating mechanism selectively positioning the blade holding mechanism against the elastic biasing action of the first spring to an operating position in which the cleaning blade is pressed against the surface of the photosensitive member. The operating mechanism includes a clutch with an input drivingly connected to the photosensitive member drive system, a cam, a cam follower, and a power transmission arrangement for transmitting power from the cam to position the blade holding mechanism so that the cleaning blade is pressed against the surface of the photosensitive member. The power transmission arrangement includes a first power transmission member, having an input terminal on which the cam acts, and a second power transmission member, having an output terminal acting on the blade holding mechanism.

7 Claims, 5 Drawing Figures

CLEANING DEVICE IN ELECTROSTATIC COPYING APPARATUS

FIELD OF THE INVENTION

This invention relates to a cleaning device in an electrostatic copying apparatus, and more specifically, to a cleaning device of the type in which residual toner particles remaining on the surface of a photosensitive member are removed by means of a cleaning blade.

DESCRIPTION OF THE PRIOR ART

A cleaning device using a cleaning blade has previously been proposed in an electrostatic copying apparatus in order to remove residual toner particles from a photosensitive member of a rotating drum after a toner image formed on the photosensitive member has been transferred to a copying paper. This cleaning device is characterized by the fact that residual toners can be removed effectively by using a relatively simple arrangement because the residual toner particles on the photosensitive member are removed by pressing the tip portion of the cleaning blade against the photosensitive member on the rotating drum and thereby causing the relative movement of the photosensitive member and the cleaning blade. Because of this characteristic, many cleaning devices having a cleaning blade have recently been used in electrostatic copying apparatuses.

The cleaning device having a cleaning blade, however, has the following problems.

(a) It is difficult to bring the tip portion of the cleaning blade into contact with the surface of the photosensitive member uniformly at a predetermined pressure over the entire width of the photosensitive member. Consequently, the residual toner particles cannot be easily removed from the photosensitive member.

(b) When the tip portion of the cleaning blade is in constant (even at times other than the copying cycle) contact with the surface of the photosensitive member, toner particles removed from the surface of the photosensitive member accumulate at the contacting part between the tip portion of the cleaning blade and the surface of the photosensitive member. The accumulated residual toner particles adversely affect the photosensitive member and scatter within the housing of the copying apparatus during the next cycle of the copying process.

In order to solve the problem (b) mentioned above, a cleaning device was proposed in which the residual toner particles are removed from the surface of the photosensitive member by keeping an electromagnetic solenoid in operation only during the copying cycle and thus pressing the cleaning blade against the photosensitive member. However, this causes the disadvantage that the electromagnetic solenoid must be kept in constant operation during the copying cycle, and thus the power consumption of the electrostatic copying apparatus increases. Moreover, since the contacting pressure between the cleaning blade and the photosensitive member is relatively high, the electromagnetic solenoid should be of relatively large size.

Various other cleaning devices have been proposed in an attempt to solve the problem (a) or (b) described above, but none of them have proved to be entirely satisfactory and have given a complete solution to the problem (a) or (b).

SUMMARY OF THE INVENTION

It is an object of this invention therefore to provide a cleaning device in an improved small-sized electrostatic copying apparatus with reduced power consumption, which can more completely remove residual toner particles from the surface of a photosensitive member.

Another object of this invention is to provide a cleaning device in an improved electrostatic copying apparatus, which is particularly effectively applicable to an electrostatic copying apparatus in which a supporting frame having a rotating drum with a photosensitive member thereon and a developing device are slidably mounted on a housing.

Other objects of this invention will become apparent from the following description made with reference to the accompanying drawings.

According to this invention, there is provided a cleaning device in an electrostatic copying apparatus for removing residual toner particles from the surface of a photosensitive member adapted to move through an endless conveying passage, said cleaning device comprising a blade holding mechanism mounted pivotally around an axis extending substantially parallel to the surface of the photosensitive member and substantially perpendicular to the moving direction of the photosensitive member, a cleaning blade mounted on the blade holding mechanism, a first spring means for elastically biasing the blade holding mechanism to a non-operating position at which the cleaning blade moves away from the surface of the photosensitive member, and an operating mechanism for selectively positioning the blade holding mechanism against the elastic biasing action of the first spring means at an operating position at which the cleaning blade is pressed on the surface of the photosensitive member, said operating mechanism including a clutch means, an input element disposed on the input side of the clutch means and drivingly connected to a drive system for moving the photosensitive member, a cam disposed on the output side of the clutch means, a clutch control means for controlling the operation of the clutch means, and a power transmission arrangement having a cam follower cooperating with the cam at one end with the other end capable of acting on the blade holding member, whereby when the clutch means is operated to hold the cam at an operating position, the other end of the power transmission arrangement acts on the blade holding mechanism to position the blade holding mechanism at the operating position against the elastic biasing action of the first spring means, and when the clutch means is operated to hold the cam at a non-operating position, the blade holding mechanism is returned to the non-operating position by the elastic biasing action of the first spring means.

Furthermore, according to this invention, there is provided a cleaning device for removing residual toner particles from the surface of a photosensitive member in an electrostatic copying apparatus of the type including a supporting frame mounted slidably in the front and rear direction between an operating position located within the housing of the electrostatic copying apparatus and a pull-out position forwardly of the housing and a photosensitive member disposed on the peripheral surface of a rotating drum rotatably mounted on the support frame, said cleaning device comprising a cleaning device supporting frame mounted on the support frame, a blade supporting mechanism mounted on the cleaning device holding frame for free pivotal movement around an axis extending substantially parallel to the rotating axis of the rotating drum, a cleaning blade mounted on the blade holding mechanism, a first spring means interposed between the cleaning device supporting frame and the blade holding mechanism for elastically biasing the blade holding mechanism to a non-operating position at which the cleaning blade moves away from the surface of the photosensitive member, an operating source disposed at a predetermined position within the housing and adapted to be selectively kept in an operating condition and a non-operating condition, and a power transmission arrangement between the operating source and the blade holding mechanism which when the operating source is kept in the operating condition, selectively positions the blade holding mechanism against the elastic biasing action of the first spring means at an operating position at which the cleaning blade is pressed on the surface of the photosensitive member, said power transmission arrangement including a first pbwer transmission member having an input terminal on which the operating source acts and a second power transmission member having an output terminal acting on the blade holding mechanism, said first power transmission member being mounted at a predetermined position within the housing and said second power transmission member being mounted on the cleaning device supporting frame, whereby when the support frame is held at the operating position, the input terminal of the second power transmission member is positioned in cooperating relation to the output terminal of the first power transmission member.

BRIEF DESCRIPTION OF THE ACCOMPANYING DRAWINGS

DETAILED DESCRIPTION OF THE PREFERRED EMBODIMENTS

Preferred embodiments of the cleaning device in the electrostatic copying apparatus constructed in accordance with this invention are described with reference to the accompanying drawings.

Figure 1:
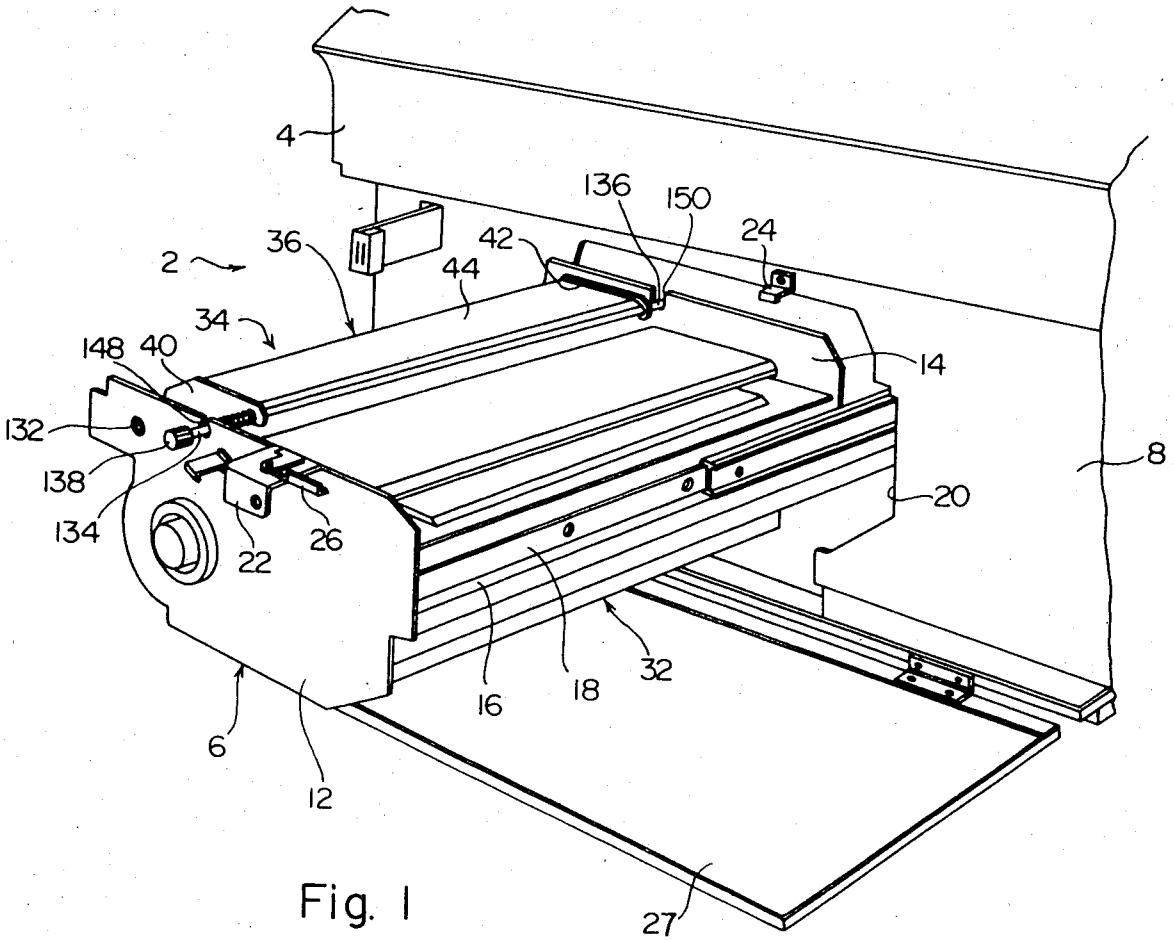
FIG. 1 is a partly omitted perspective view showing an electrostatic copying apparatus equipped with a cleaning device constructed in accordance with the present invention.

In FIG. 1, an electrostatic copying apparatus shown generally by reference numeral 2 has a housing 4. On the housing 4 is mounted slidably in the front and rear direction a support frame 6. The support frame 6 includes a front support wall 12 and a rear support wall 14 located substantially horizontally with a predetermined space therebetween in the front and rear direction, which space nearly corresponds to the space between a vertical front base plate 8 and a vertical rear base plate 10 (FIG. 2) provided within the housing 4. Horizontal members 16 (only one is shown in FIG. 1) are fixed between the opposite end portions of the front support wall 12 and the rear support wall 14. Guide rails 18 (only one of which is shown in FIG. 1) adapted to engage a pair of support rails (not shown) mounted within the housing 4 for slidable movement in the front and rear direction are fixed respectively to the horizontal members 16. An opening 20 having a shape corresponding to the shape of the support frame 6 is formed in the vertical front base plate 8, and therefore, the support frame 6 is slidable in the front and rear direction between a predetermined operating position within the housing 4 (the position at which the copying process is performed) at which the front support wall 12 is in substantially the same plane as the vertical front base plate 8 through this opening 20. The rear support wall 14 adjoins the vertical rear base plate 10 and a predetermined pull-out position forwardly of the housing 4 of the electrostatic copying apparatus (the position shown in FIG. 1 at which a rotating drum and a developing device to be described are mounted on the supporting frame 6).

The upper end portion of the front support wall 12 has provided therein a grip portion 22 which extends forwardly and whose tip portion extends downwardly. A locking means 26 adapted to cooperate with an engaging piece 24 provided on the front surface of the vertical front base plate 8 is mounted on the upper surface of the grip portion 22. The locking means 26 is a means known per se which when the support frame 6 is at a predetermined operating position, can be elastically forced by an elastic means such as a spring into engagement with the engaging piece 24, and disengaged from the engaging piece 24 by a manual operation.

Accordingly, in the aforesaid electrostatic copying apparatus 2, the support frame 6 can be positioned at the predetermined pull-out position by opening a front door 27 of the housing 4 forwardly and downwardly, releasing the engagement of the engaging piece 24 with the locking means 26, and pulling out the gripping portion 22 forwardly. On the other hand, the support frame 6 can be held at the predetermined operating position by pressing the gripping portion 22 rearwardly and engaging the engaging piece 24 with the locking means 26.

A rotating drum 28 (see FIG. 2) is rotatably mounted on the support frame 6, more specifically between the front support wall 12 and the rear support wall 14, and a photosensitive member 30 is disposed on at least a part of the peripheral surface of the rotating drum 28 (in the illustrated embodiment, the entire peripheral surface of the rotating drum 28). Accordingly, the photosensitive member 30 is moved through a circular endless conveying passage defined by the peripheral surface of the rotating drum 28 by the rotation of the rotating drum 28. It is possible to mount an endless belt-like material well known to those skilled in the art instead of the rotating drum 28 and to dispose the photosensitive member on at least a part of the surface of the endless belt-like member. In this embodiment, the photosensitive member is moved through an endless conveying passage defined by the surface of the endless belt-like member by the movement of the endless beltlike member.

A developing device 32 for developing a latent electrostatic image formed on the photosensitive member 30 is mounted on the support frame 6 at a predetermined position opposite to the rotating drum 28. The latent electrostatic image on the photosensitive member is formed by a latent electrostatic image-forming means (not shown) known per se which is disposed within the housing 4 of the copying apparatus.

The structures of the rotating drum 28 and the developing device 32 and the mounting of these members on the supporting frame 6 are substantially the same as those described in the specification and drawings of Japanese Patent Application No. 63863/1982 filed Apr. 19, 1982 and entitled "Electrostatic Copying Apparatus". For details, therefore, reference may be made to the specification and drawings of this patent application.

The electrostatic copying apparatus 2 having the support frame 6 of the above construction further includes a cleaning device generally shown at 34 and constructed in accordance with the present invention.

Figure 2:
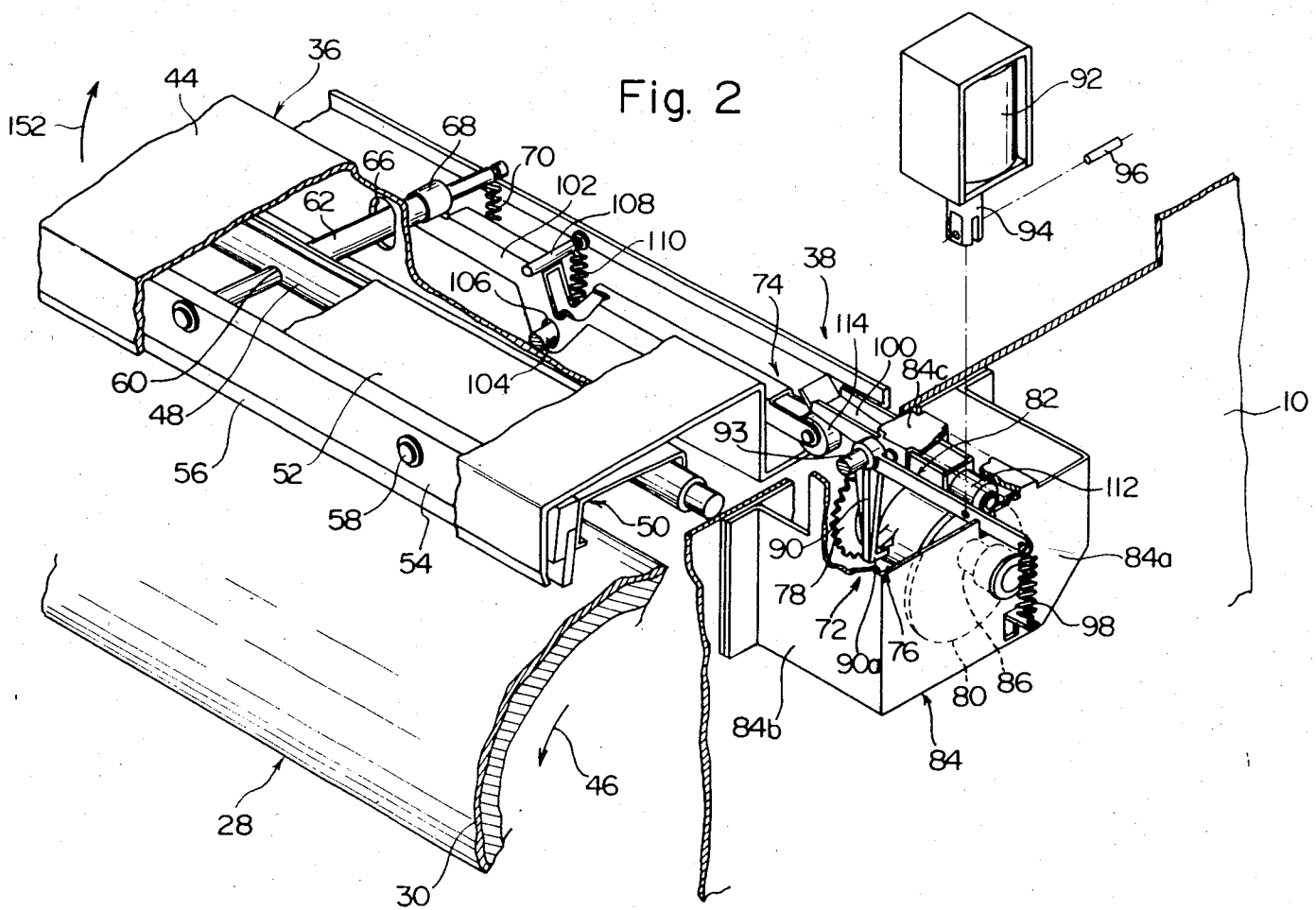
FIG. 2 is a partly broken-away perspective view showing the cleaning device illustrated in FIG. 1.

As shown in FIGS. 1 and 2, the cleaning device 34 includes a cleaning device supporting frame 36 and an operating mechanism 38 (to be more fully described hereinbelow). The cleaning device supporting frame 36 is mounted on the support frame 6. The cleaning device supporting frame 36 has a front wall 40 and a rear wall 42 located substantially parallel to each other with a predetermined space therebetween in the front and rear direction, which space corresponds nearly to the space between the front support wall 12 and the rear support wall 14 of the support frame 6, and a support frame main body 44 fixed between the front wall 40 and the rear wall 42 (in FIG. 2, the front wall 40 and the rear wall 42 are omitted). Beneath the cleaning device supporting frame 36, more specifically the main body 44 between the front wall 40 and the rear wall 42, is rotatably mounted a support shaft 48 extending substantially parallel to the surface of the photosensitive member 30 and substantially perpendicular to the moving direction of the photosensitive member 30 shown by an arrow 46, and a blade holding mechanism 50 is fixed to the support shaft 48. When the photosensitive member 30 is disposed on the peripheral surface of the rotating drum 28 as in the illustrated embodiment, the support shaft 48 is mounted rotatably substantially parallel to the rotating axis of the rotating drum 28.

The blade holding mechanism 50 has a blade holding main body 52 and a blade holding member 54, and the rear end portion of the blade holding main body 52 is connected to the support shaft 48 through an operating shaft 62 to be described hereinafter. To the blade holding member 54 is fixed the upper end portion of the cleaning blade 56, and the blade holding member 54 is fixed to the forward end portion of the blade holding main body 52 by means of screws 58 (one of which is shown in the drawing).

As is clear from FIG. 2, the blade holding main body 52 and the blade holding member 54 are covered at their top with the support frame main body 44. In the illustrated embodiment, the cleaning blade 56 is fixed to the blade holding member 54 by means of an adhesive, etc. If desired, the cleaning blade 56 may alternatively be mounted on the end portion of the blade holding main body 52 by interposing the cleaning blade 56 between the end portion of the blade holding main body 52 and the blade holding member 54 and fixing the blade holding member 54 to the blade holding main body 52 by means of a screw, etc. Accordingly, the blade holding mechanism 50 having the cleaning blade 56 mounted thereon is pivotable about the support shaft 48 between an operating position at which the cleaning blade 56 is pressed on the surface of the photosensitive member 30 of the rotating drum 28 and a non-operating position at which the cleaning blade 56 is moved away from the surface of the photosensitive member 30.

The support shaft 48 has a through hole 60 formed at its nearly central part in a direction substantially perpendicular to the axis of the support shaft 48, i.e. to the rotating axis of the rotating drum 28. An actuating shaft 62 is rotatably mounted in the through hole 60, and the blade holding member 54 is pivotally connected to one end portion of the actuating shaft 62. The rear end portion of the blade holding main body 52 is also connected pivotally to the actuating shaft 62. Hence, the blade holding main body 52, the blade holding member 54 and the cleaning blade 56 are pivotally mounted on the actuating shaft 62, whereby the pressing force of the cleaning blade 56 on the photosensitive member 30 in the direction of the rotating axis of the rotating drum 28 is uniformly maintained. On the other hand, the other end portion of the actuating shaft 62 extends outwardly through a long hole 66 formed in the perpendicular wall of the support frame main body 44, and a collar member 68 is mounted on its rear end portion. A spring member 70 (constituting a first spring means) having one end portion fixed to the supporting frame main body 44 is mounted at its other end portion on the rear end of the actuating shaft 62 outwardly of the collar member 68. The spring member 70 acts through the actuating shaft 62 on the blade holding main body 52 to pivot the blade holding main body 52 about the supporting shaft 48 clockwise in FIG. 2 and elastically bias it to a non-operating position at which the cleaning blade 56 moves away from the photosensitive member 30 of the rotating drum 28.

Accordingly, in the blade holding mechanism 50, the blade holding main body 52 having the cleaning blade 56 mounted thereon is pivotable not only about the support shaft 48 (acting as a pivot axis for the blade holding main body 52) but also about the actuating shaft 62 (acting as a pivot axis for the blade holding main body 52).

The operating mechanism 38 of the cleaning device 34 includes an operating source 72 and a power transmission arrangement 74. The operating source 72 is comprised of a clutch mechanism 76, a sprocket 78 (constituting an input element) drivingly connected to a drive source (not shown), a disc-like eccentric cam 80 and a clutch control means 82. This operating source 72 is mounted on a supporting base plate 84 fixed to the vertical rear base plate 10 within the housing 4 of the copying apparatus. In more detail, with reference to FIGS. 2 and 4, a shaft member 86 one end portion of which extends inwardly is rotatably mounted on a rear plate 84*a* of the supporting base plate 84, and the clutch means 76 and the eccentric cam 80 are fixed to the shaft member 86. The clutch means 76 is constructed of a known spring clutch having two stop claws 88*a* and 88*b* provided at opposite positions (180 degrees) with a predetermined space therebetween in the front and rear direction and a spring member 89, and a sprocket 78 is disposed on its input side. The driving of the sprocket 78 will be described in more detail hereinafter.

The clutch control means 82 has an L-shaped anchoring member 90 for anchoring the stop claws 88*a* and 88*b* of the clutch means 76 and an electromagnetic solenoid 92. The anchoring member 90 is rotatably mounted on a shaft 93 fixed to a right-side plate 84*b* of the supporting base plate 84, and the electromagnetic solenoid 92 is fixed to the vertical rear base plate 10. The anchoring member 90 has formed at its one end portion an anchoring portion 90*a* for anchoring the stop claws 88*a* and 88*b* and the output shaft 94 of the electromagnetic solenoid 92 is connected to the other end portion of the anchoring member 90 by means of a pin 96. A spring member 98 (constituting a second spring means) having its one end portion fixed to the rear wall 84*a* of the supporting base plate 84 is connected at its other end portion to the other end of the anchoring member 90. The spring member 98 acts to bias elastically the anchoring member 90 clockwise in FIG. 2 around the shaft 93. Accordingly, when the electromagnetic solenoid 92 is not energized, the operating source 72 having clutch control means 82 is maintained in a non-operating condition (shown by solid lines in FIGS. 2 and 4) in which the action of spring member 98 causes the other end portion of the anchoring member 90 to abut against the cut portion of the rear wall 84*a* of the supporting base plate 84 and thereby stops its rotation and the anchoring portion 90*a* of the anchoring member 90 is held at a first anchoring position (shown by a solid line in FIG. 4) at which it anchors the stop claw 88*a* of the clutch means 76. When the electromagnetic solenoid 92 is energized, the operating source 72 is maintained in an operating condition (shown by a two-dot chain line in FIG. 4) in which the anchoring portion 90*a* of the anchoring member 90 is held at a second anchoring position (shown by a two-dot chain line 90A in FIG. 4) at which it anchors the stop claw 88*b* of the clutch means 76. When the operating source 72 is in its non-operating condition, the eccentric cam 80 is held at a non-operating position (in the illustrated embodiment, this is a position at which the minimum radius portion of the eccentric cam 80 is located above as shown by a solid line in FIG. 4). When the operating source 72 is in its operating condition, the eccentric cam 80 is held at an operating position (at which the maximum radius portion is located above). When the anchoring portion 90*a* of the anchoring member 90 is at a first anchoring position at which it anchors the stop claw 88*a* or a second anchoring position at which it anchors the stop claw 88*b*, the driving force on the input side of the clutch means 76 is naturally not transmitted to the output side, and therefore, the eccentric cam 80 is not rotated.

The power transmission arrangement 74 will now be described in detail. The power transmission arrangement 74 has a first power transmission member 100 and a second power transmission member 102. A nearly central portion of the first power transmission member 100 is pivotally mounted on a shaft 85 mounted on the upper wall 84*c* of the supporting base plate 84, and a nearly central portion of the second power transmission member 102 is mounted on a shaft 104 fixed to the vertical wall of the support frame main body 44. An elongated hole 106 is formed through a nearly central portion of the second power transmission member 102, and by inserting the shaft 104 into hole 106, the second power transmission member 102 is mounted on the support frame main body 44. Hence, the second power transmission member 102 is mounted on the supporting frame main body 44 pivotally and movably in a predetermined direction (the longitudinal direction of hole 106). A spring member 110 (constituting a third spring means) having one end fixed to a shaft 108 secured to the vertical wall of the supporting frame main body 44 is further mounted at its other end on a nearly central portion of the second power transmission member 102. The spring member 110 acts to elastically bias the power transmission member 102 upwardly, namely in a direction which is upward in FIGS. 2 and 4 and holds the cleaning blade 56 at its operating position through the actuating shaft 62.

One end portion of the first power transmission member 100 constitutes an input terminal to be connected to the operating source 72 and its other end portion constitutes an output terminal to be connected to the second power transmission member 102. A cam follower 112 adapted to contact the eccentric cam 80 of the operating source 72 is rotatably mounted on the input terminal of the first power transmission member 100. One end portion of the second power transmission member 102 constitutes an input terminal to be connected to the output terminal of the first power transmission member 100, and its other end portion constitutes an output terminal to be connected to the collar member 68 mounted on the actuating shaft 62. A roller 114 adapted for abutment against the under surface of the output terminal of the first power transmission member 100 is rotatably mounted on the input terminal of the second power transmission member 102 by means of a shaft 115. It will be easily understood therefore that in the power transmission arrangement 74 comprised of the first power transmission member 100 and the second power transmission member 102, one end is constituted by the input terminal of the first power transmission member 100 and the other end, by the output terminal of the second power transmission member 102.

Figure 4:
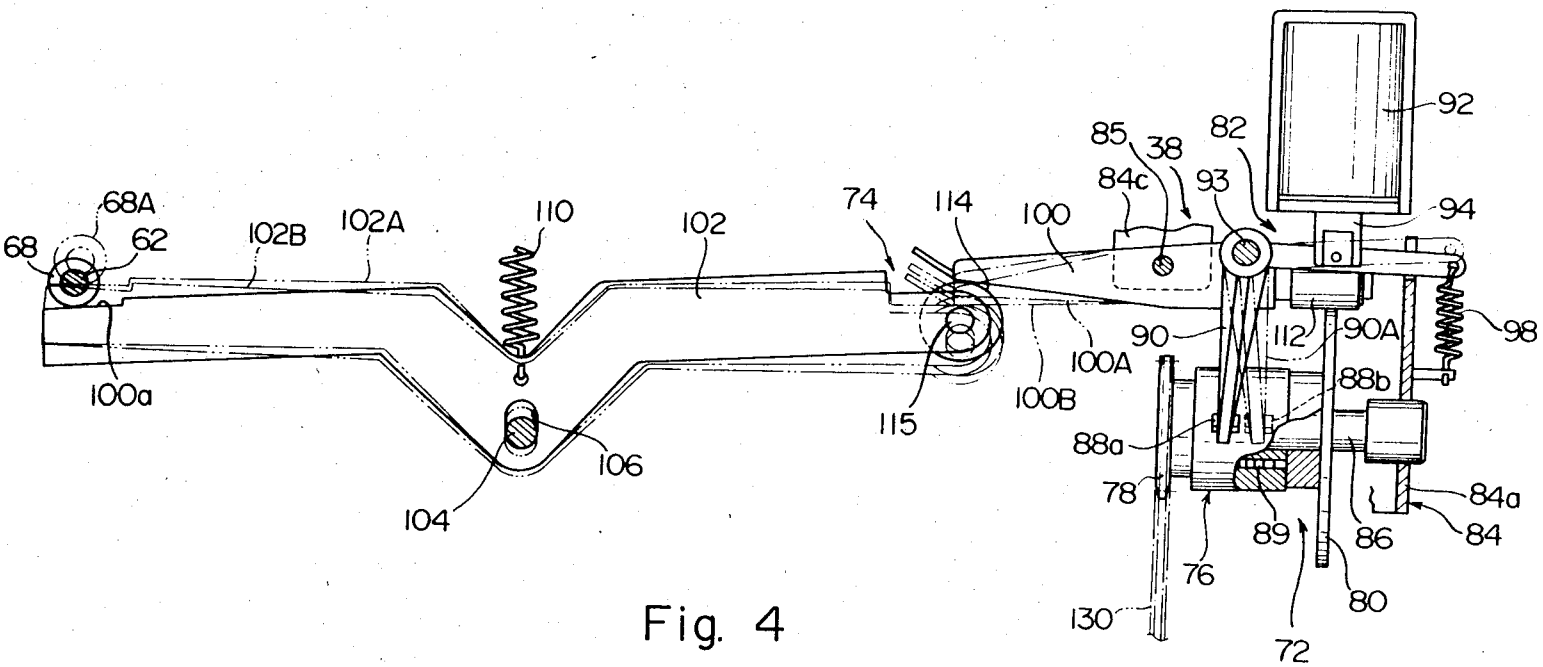
FIG. 4 is a partly broken-away sectional view showing the operating mechanism of the cleaning device shown in FIG. 1.

In the power transmission arrangement 74 described above, when the eccentric cam 80 is held, for example, at its operating position with its rotation, the action of the eccentric cam 80 causes the first power transmission member 100 to pivot counterclockwise in FIG. 4 through the cam follower 112, and by the action of the output terminal of the first power transmission member 100 on the input terminal of the second power transmission member 102, the second power transmission member 102 is pivoted clockwise in Figure 4 about the shaft 104 against the force of the spring member 70, whereby the output terminal of the second power transmission member 102 is moved upwardly in FIG. 4. As a result, the rear end portion of the actuating shaft 62 is moved upwardly with the movement of the output terminal of the second power transmission member 102, and through the actuating shaft 62, the blade holding mechanism 50 is held at its operating position at which the cleaning blade 56 is pressed on the photosensitive member 30. On the other hand, when the eccentric cam 80 is moved away from the operating position and held at its non-operating position, the action of the spring member 70 causes the second power transmission member 102 to pivot counterclockwise in FIG. 4 through the actuating shaft 62, and by the action of the input terminal of the second power transmission member 102 on the output terminal of the first power transmission member 100, the first power transmission member 100 is pivoted clockwise in FIG. 4 about the shaft 85 and maintained in the condition shown by a solid line in FIG. 4. As the rear end portion of the actuating shaft 62 is moved downwardly in FIG. 4, the blade holding mechanism 50 is held at its non-operating position at which the cleaning blade 56 is moved away from the surface of the photosensitive member 30.

Since in the aforesaid power transmission arrangement 74 the spring member 70 elastically biases the rear end portion of the actuating shaft 62 downwardly in FIGS. 2 and 4 and the spring member 110 elastically biases the second power transmission member 102 upwardly in FIGS. 2 and 4, the abutting of the output terminal of the first power transmission member 100 and the roller 114 at the input terminal of the second power transmission member 102 and the abutting of the output terminal of the second power transmission member 102 against the collar member 68 of the actuating shaft 62 are not released.

Figure 5:
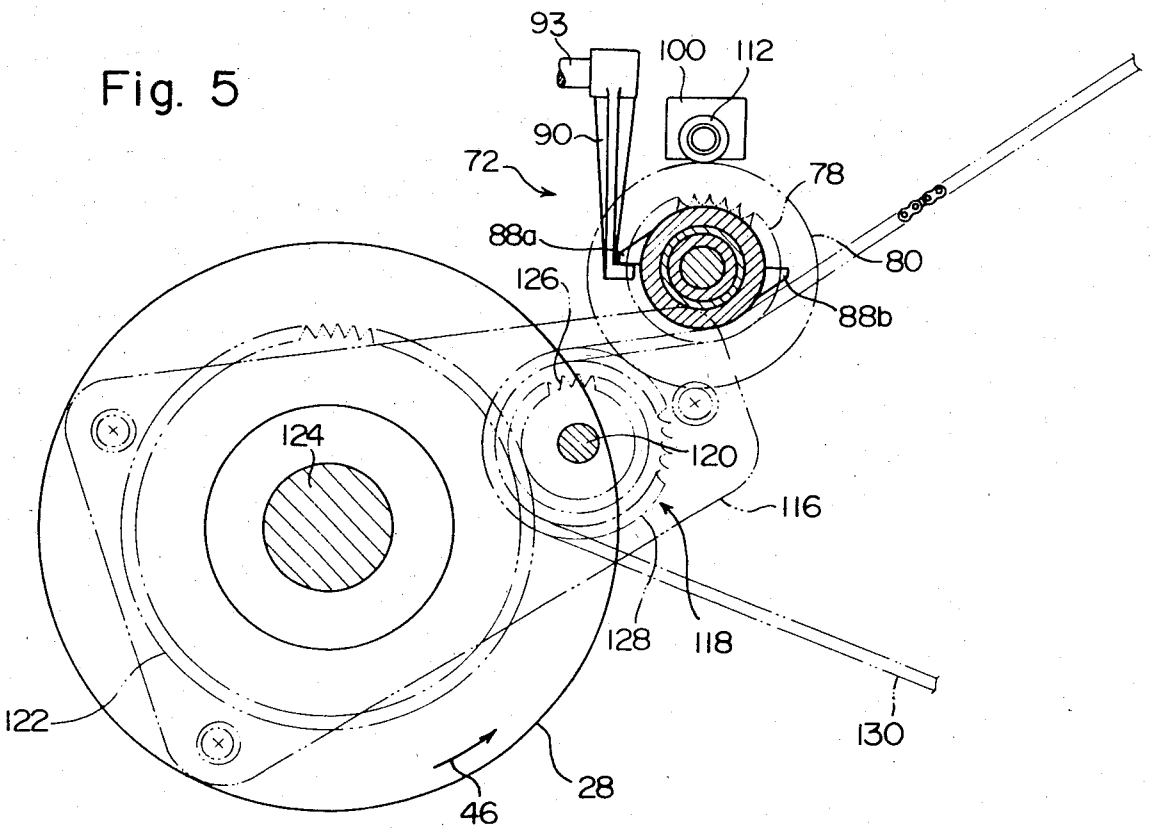
FIG. 5 is a sectional view showing a part of a drive system in the cleaning device shown in FIG. 1.

Now, with reference to FIG. 5, the driving of the sprocket 78 of the operating source 72 will be described. An auxiliary base plate 116 is fixed to the vertical rear base plate 10 (omitted in FIG. 5) of the housing 4 of the copying apparatus. A shaft 120 having a linking sprocket 118 rotatably mounted thereon is fixed to the auxiliary base plate 116, and an input shaft 124 having fixed thereto a large gear 122 for driving the rotating drum 28 is rotatably mounted on the auxiliary base plate 116. The large gear 122 is drivingly connected to the gear 126 of the linking sprocket 118. When the support frame 6 having the rotating drum 28 mounted thereon is held at a predetermined operating position within the housing 4 of the copying apparatus, the input shaft 124 is drivingly connected to a known linking clutch (not shown) mounted on one end portion of the rotating drum 28, and the driving force of the large gear 122 is transmitted to the rotating drum 28 through the input shaft 124 and the linking clutch. A part of an endless chain 130 is stretched over a sprocket 128 of the linking sprocket 118 and the sprocket 78 of the operating source 72. The endless chain 130 is wrapped about a sprocket (not shown) fixed to the output shaft of a drive power source (not shown) for the electrastatic cpying apparatus 2, such as an electric motor. Accordingly, when the driving power source (not shown) is rotated and driven, the sprocket 78 and the sprocket 128 of the linking sprocket 118 are rotated through the endless chain 130. As a result of the rotation of the sprocket 128, the rotating drum 28 is rotated in the direction shown by the arrow 46 in FIG. 2 by the gear 126 of the linking sprocket 118, the large gear 122, the input shaft 124 and the linking clutch (not shown).

Figure 3:
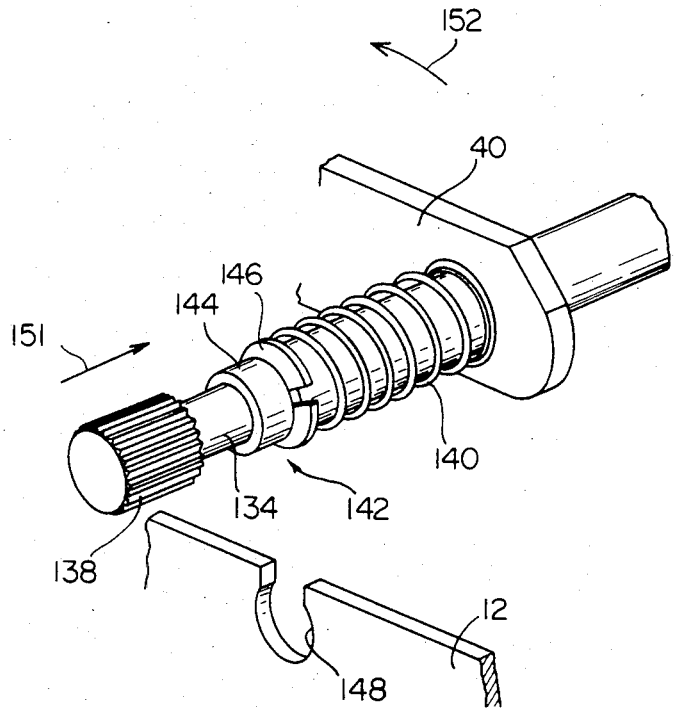
FIG. 3 is a perspective view illustrating a part of the supporting frame and the front wall of the cleaning device in the electrostatic copying apparatus illustrated in FIG. 1.

The mounting of the cleaning device supporting frame 36 of the cleaning device 34 of the aforesaid structure will be described. In FIG. 1, the front surface of the front wall 40 and the rear surface of the rear wall 42 of the cleaning device supporting frame 36 have provided at opposite end portions 132 (only the projecting portion at the front wall is shown in the drawing), projecting forwardly and rearwardly substantially parallel to the rotating axis of the rotating drum 28, projecting portions 134 and 136 having a circular peripheral surface and projecting further forwardly and rearwardly beyond the opposite end portions 132 respectively. Grip portions 138 (the grip portion of the projecting portion 136 is not shown) are formed at the tip portions of the projecting portions 134 and 136 respectively. A spring member 140 and a stop member 142 are further mounted on the projecting portion 134 at the front wall 40 of the cleaning device supporting frame 36 as shown in FIG. 3. The stop member 142 is comprised of a main portion 144 having a circular peripheral surface and an engaging portion 146 formed at one end portion of the main portion 144 and having a larger circular peripheral surface than the main portion 144.

An opening (not shown) and upwardly opened circular openings 148 and 150 are formed respectively at predetermined positions of the front support wall 12 and the rear support wall 14 of the support frame 6 having the cleaning device supporting frame 36 mounted thereon. The upper opening widths of the circular openings 148 and 150 are set at a slightly larger value than the outside diameters of the projecting portions 134 and 136 respectively and smaller than the outside diameter of the main portion 144 of the stop member 142, and the diameters of the circular openings 148 and 150 are set at a value slightly larger than the outside diameter of the main portion 144 of the stop member 142 and smaller than the outside diameter of the engaging portion of the stop member 142.

The cleaning device supporting frame 36 can be mounted on the support frame 6 by rotatably mounting the projecting portions 132 of the supporting frame 36 respectively in the openings (not shown) formed on the front support wall 12 and the rear support wall 14, grasping the stop member 142 by hand and pressing it in the direction of an arrow 151 in FIG. 3 against the force of the spring member 140, and thereafter inserting the projecting portions 134 and 136 respectively into the circular openings 148 and 150. When the cleaning device supporting frame 36 has been mounted on the support frame 6, the stop member 142 is moved forwardly by the action of the spring member 140, whereby the main portion 144 of the stop member 142 is inserted into the opening 148 and the engaging portion 146 of the stop member 142 is caused to abut against the rear surface of the front support wall 12 to hold the cleaning device supporting frame 36 lockingly on the support frame 6. Thus, the rotation of the cleaning device supporting frame 36 is hampered, and it is fixed accurately to the support frame 6.

In the above-described specific embodiment, the spring member 140 and the stop member 142 are mounted only on the projecting portion 134. But in order to make the mounting of the cleaning device supporting frame 36 more accurate, the spring member 140 and the stop member 142 may be mounted on each of the projecting portions 134 and 136.

When in the electrostatic copying apparatus 2 having the aforesaid cleaning device 34, the support frame 6 having the cleaning device supporting frame 36 mounted thereon is moved from the predetermined pull-out position forwardly of the housing 4 of the copying apparatus 2 and held at the predetermined operating position within the housing 4, the roller 114 at the input terminal of the second power transmission member 102 is caused to abut against the output terminal of the first power transmission member 100 and is positioned in cooperating relation to the output terminal of the first power transmission member 100, as shown by a solid line in FIG. 4.

On the other hand, when the support frame 6 is moved away from the predetermined operating position within the housing 4 and held at the predetermined pull-out position, the cooperative relation between the input terminal of the second power transmission member 102 and the output terminal of the first power transmission member 100 is released, as will be readily seen from the foregoing description and FIGS. 2 and 4. Accordingly, if at this predetermined pull-out position the gripping portion 138 is moved by hand in the direction of arrow 151 against the force of the spring member 140 to release the locking with the supporting frame 6, the cleaning device supporting frame 36 can be turned in a direction away from the surface of the photosensitive member 30 of the rotating drum 28 as shown by an arrow 152 in FIGS. 2 and 3 about the projecting portion 132 (acting as a pivot axis for the supporting frame 36).

Accordingly, in the event that a copying paper should be held adherent to the surface of the photosensitive member 30, it can be easily removed from the surface of the photosensitive member 30 without damage by turning the cleaning device supporting frame 36 as described above.

In the illustrated embodiment, in order to effect the abutment of the output terminal of the first power transmission member 100 against the roller 114 of the input terminal of the second power transmission member 102 easily and accurately, an upwardly inclined guide surface 100*a* (FIG. 4) is formed at the end portion of the output terminal of the first power transmission member 100.

Now, with reference to FIGS. 2, 4 and 5, the operation and advantage of the cleaning device 34 having the aforesaid construction will be described.

When the electromagnetic solenoid 92 is energized while the driving source (not shown) is driven [for example, after the lapse of a predetermined period from the depression of a copying cycle start switch (not shown)], the anchoring member 90 is turned counterclockwise in FIG. 4 against the force of the spring member 98 from the first anchoring position shown by a solid line in FIG. 4 at which the engaging portion 90*a* of the anchoring member 90 anchors the stop claw 88*a* of the clutch means 76 to the second anchoring position shown by the two-dot chain line 90A in FIG. 4 at which the engaging portion 90*a* of the anchoring member 90 anchors the stop claw 88*b*. As a result, the anchoring of the stop claw 88*a* by the engaging portion 90*a* of the anchoring member 90 is released and the clutch 76 becomes connected. Thus, the rotating driving force of the sprocket 78 rotating by the driving source is transmitted to the eccentric cam 80 through the clutch means 76 to rotate the eccentric cam 80. When the eccentric cam 80 rotates through a half turn, the clutch means 76 is rotated through a half turn, and the stop claw 88*b* of the clutch means 76 engages the engaging portion 90*a* of the anchoring member 90 being in the second anchoring position. As a result, the connected condition of the clutch means 76 is released and the eccentric cam 80 is held at its operating position. Hence, the operating source 72 is maintained in an operating condition. When the eccentric cam 80 has been held at its operating position, the action of the eccentric cam 80 causes the first power transmission member 100 to pivot counterclockwise in FIG. 4 through the cam follower 112, and the output terminal of the first power transmission member 100 acts on the input terminal of the second power transmission member 102, whereby the second power transmission member 102 is pivoted clockwise in FIG. 4 against the force of the spring member 70. Thus, the first power transmission member 100 and the second power transmission member 102 assume the state shown by two-dot chain lines 100B and 102B in FIG. 4, and the output terminal of the second power transmission member 102 is moved upwardly in FIG. 4. Thus, with the movement of the output terminal of the second power transmission member 102, the rear end portion of the actuating shaft 62 is moved upwardly, and, through the actuating shaft 62, the blade holding member 54 is pivoted downwardly toward the photosensitive member 30. As a result, the blade holding mechanism 50 is held at its operating position at which the cleaning blade 56 is pressed on the photosensitive member 30.

The operations of the first power transmission member 100 and the second power transmission member 102 are described in more detail with reference to FIG. 4. When the eccentric cam 80 is turned to move the cam follower 112 upwardly and pivot the first power transmission member 100 counterclockwise, the second power transmission member 102 is first pivoted clockwise against the force of the spring 70 about the shaft 104. When the first power transmission member 100 is turned a predetermined amount in the counterclockwise direction and assumes the state shown by the two-dot chain line 100A, the second power transmission member 102 is also turned a predetermined amount in the clockwise direction and assumes the state shown by the two-dot chain line 102A, and the collar member 68 mounted on the actuating shaft 62 also assumes the state shown by a two-dot chain line 68A. At this time, the tip portion of the cleaning blade 56 mounted on the blade holding mechanism 50 is caused to abut against the surface of the photosensitive member 30 on the rotating drum 28. Then, when the first power transmission member 100 is turned counterclockwise from the two-dot chain line 100A and assumes the state shown by a two-dot chain line 100B, the upward movement of the actuating shaft 62 is hampered because the cleaning blade 56 is caused to abut against the surface of the photosensitive member 30. The second power transmission member 102 is turned clockwise against the elastic force of the spring member 110 about the abutting portion between its output terminal and the collar member 68 as a center (fulcrum) and assumes the states shown by a two-dot chain line 102B. Hence, the elastic biasing force of the spring member 110 acts on the cleaning blade 56 through the actuating shaft 62, and by the elastic biasing force of the spring member 110, the cleaning blade 56 is pressed against the surface of the photosensitive member 30. Thus, the pressing force of the cleaning blade 56 can be made uniform.

In order to pivot the first power transmission member 100 and the second power transmission member 102 as stated above, it is important that the spring member 110 should elastically bias the second power transmission member 102 with a larger elastic biasing force than the elastic biasing force of the spring member 70.

Since in the aforesaid specific embodiment, the blade holding main body 52 having the cleaning blade 56 mounted thereon is further mounted pivotally on the actuating shaft 62, the cleaning blade 56 can be pressed uniformly over the entire width of the rotating drum 28 when the cleaning blade 56 is at its operating position.

When the electromagnetic solenoid 92 is deenergized during the driving of the drive source (not shown), the action of the spring member 98 causes the anchoring member 90 to rotate clockwise in FIG. 4 about the shaft 93 as a center from the second anchoring position shown by the two-dot chain line 90A in FIG. 4 at which the engaging portion 90*a* of the anchoring member 90 anchors the stop claw 88*b* to the first anchoring position shown by a solid line in FIG. 4 at which the anchoring portion 90*a* of the anchoring member 90 anchors the stop claw 88*a*. As a result, the anchoring of the stop claw 88*b* by the engaging portion 90*a* of the anchoring member 90 is released and the clutch means 76 becomes connected. As a result, the rotating force of the sprocket 78 rotated by the drive source is transmitted to the eccentric cam 80 through the clutch means 76 to rotate the eccentric cam 80. When the eccentric cam 80 rotates through a half turn, the clutch means 76 also rotates through a half turn to anchor the stop claw 88*a* of the clutch means 76 by the engaging portion 90*a* of the anchoring member 90 held at the first anchoring position and to release the connection of the clutch means 76, whereby the eccentric cam 80 is held at its non-operating position and therefore the operating source 72 is maintained in a non-operating condition. When the eccentric cam 80 is held at its non-operating position, the actions of the spring members 70 and 110 cause the second power transmission member 102 to pivot counterclockwise from the state shown by the two-dot chain line 102B in FIG. 4. Thus, the input terminal of the second power transmission member 102 acts on the output terminal of the first power transmission member 100, whereby the first power transmission member 100 is pivoted clockwise from the state shown by the two-dot chain line 100B in FIG. 4 and assumes the state shown by a solid line in FIG. 4 At this time, as the rear end portion of the actuating shaft 62 is moved downwardly in FIG. 4, the blade holding mechanism 50 is held at its non-operating position at which the cleaning blade 56 is moved away from the surface of the photosensitive member 30.

While the specific embodiments of the cleaning device in the electrostatic copying apparatus constructed in accordance with this invention have been described hereinabove with reference to the accompanying drawings, it should be understood that the present invention is not limited to these specific embodiments, and various changes and modifications are possible without departing from the scope of the invention.

For example, in the illustrated embodiments, two stop claws are provided in the clutch means with a predetermined distance therebetween in the front and rear directions. When the electromagnetic solenoid is energized, one of the stop claws engages the anchoring member to hold the cam at its operating position. When the electromagnetic solenoid is deenergized, the other stop claw engages the anchoring member to hold the cam in its non-operating position. It is possible to provide the two stop claws within the same plane instead of providing them with a space therebetween in the front and rear direction. In the latter case, the construction may be such that when the electromagnetic solenoid is deenergized, one of the stop claws engages the anchoring member to hold the cam in its operating or non-operating position, and when the electromagnetic solenoid is energized, the engagement between the stop claw and the anchoring member is released. In the alternative embodiment, the electromagnetic solenoid is energized only for a short period of time when holding the cam at its operating or non-operating position. Hence, this can reduce power consumption as compared with the specific embodiment described hereinabove in which the electromagnetic solenoid is kept energized all the time the cam is in its operating position.

What is claimed is:

1. A cleaning device for an electrostatic copying apparatus to remove residual toner particles from the surface of a photosensitive member adapted to move through an endless conveying passage in the electrostatic copying apparatus in response to actuation of a drive system, said cleaning device comprising:

a blade holding mechanism mounted for pivoting around an axis extending substantially parallel to the surface of the photosensitive member and substantially perpendicular to the moving direction of the photosensitive member, a cleaning blade mounted on the blade holding mechanism, blade-holding spring means elastically biasing the blade holding mechanism to a non-operating blade position in which the cleaning blade is away from the surface of the photosensitive member, and an operating mechanism for selectively positioning the blade holding mechanism against the elastic biasing action of the blade-holding spring means to a blade operating position in which the cleaning blade is pressed against the surface of the photosensitive member, said operating mechanism including clutch means, an input element disposed on the input side of the clutch means and drivingly connected to the drive system for the photosensitive member, a cam disposed on the output side of the clutch means, clutch control means for controlling the operation of the clutch means, and a power transmission arrangement with a first end having a cam follower cooperating with the cam and a second end capable of acting on the blade holding member, whereby when the clutch means is operated to hold the cam at a cam operating position, the second end of the power transmmision arrangement acts on the blade holding mechanism to position the blade holding mechanism at the blade operating position against the elastic biasing action of the blade-holding spring means, and when the clutch means is operated to hold the cam at a non-operating cam position, the blade holding mechanism is returned to the non-operating blade position by the elastic biasing action of the blade-holding spring means.

2. The cleaning device of claim 1 wherein the clutch means comprises a spring clutch having two engaging claws, and the clutch control means comprises an anchoring member mounted for free movement between a first anchoring position at which one of the engaging claws is anchored and a second anchoring position at which the other of the engaging claws is anchored, second spring means for elastically biasing the anchoring member to the first anchoring position, an electromagnetic solenoid which when energized, moves the anchoring member to the second anchoring position against the elastic biasing action of the second spring means, and means for energizing the solenoid, and wherein the cam is held at its non-operating cam position when one of the engaging claws is anchored by the anchoring member at the first anchoring position, and held at its cam operating position when the outer engaging claw is anchored by the anchoring member at the second anchoring position.

3. The cleaning device of claim 1 wherein the power transmission arrangement comprises a first power transmission member having an input terminal and an output terminal and pivotally mounted with said cam follower at its input terminal, a second power transmission member mounted movably in a predetermined direction and pivotally and having an input terminal adapted for abutment against the output terminal of the first power transmission member and an output terminal constituting the second end of the power transmission arrangement, and further spring means adapted for elastically biasing the second power transmission member with a larger elastic biasing force than the blade-holding spring means in said predetermined direction and in a direction in which the output terminal of the second power transmission member acts on the blade holding mechanism to hold the blade holding mechanism at the blade operating position, and wherein when the cam is moved from the non-operating cam position to the cam operating position, the first power transmission member is pivoted and its output terminal acts on the input terminal of the second power transmission member to pivot the second power transmission member, and thus the output terminal of the second power transmission member acts on the blade holding mechanism to position the blade holding mechanism at the blade operating position and simultaneously, the second power transmission member is moved against the elastic biasing action of the further spring means and the cleaning blade is pressed onto the surface of the photosensitive member by the elastic force defined by the further spring means.

4. The cleaning device of claim 1 further comprising:

a support frame mounted slidably in the front and rear direction between a drum operating position within the housing of the copying apparatus and a pull-out position forwardly of the housing, a rotatable drum having the photosensitive member disposed in the peripheral surface thereof, means rotatably mounting the rotating drum on the support frame;

a cleaning device supporting frame mounted on the support frame and having the blade holding mechanism mounted thereon with the blade-holding spring means interposed between the blade holding mechanism and the cleaning device supporting frame, and wherein:

the clutch means, the input element, the cam, and the clutch control means of the operating mechanism are mounted at predetermined positions within the housing;

said power transmission arrangement of the operating mechanism includes a first power transmission member having an input terminal and an output terminal, with the cam follower at the input terminal thereof, and a second power transmission member having an input terminal and an output terminal, with the output terminal thereof constituting the second end of the power transmission arrangement, the first power transmission member is mounted at a predetermined position within the housing, the second power transmission member is mounted on the cleaning device supporting frame, and when the support frame is held at said drum operating position, the input terminal of the second power transmission member is positioned in cooperating relation to the output terminal of the first power transmission member.

5. The cleaning device of claim 4 wherein when the support frame is pulled out to the pull-out position, the cleaning device supporting frame can be pivoted about an axis substantially parallel to the rotating axis of the rotating drum in a direction in which the cleaning blade moves away from the surface of the photosensitive member.

6. A cleaning device for removing residual toner particles from the surface of a photosensitive member in an electrostatic copying apparatus of the type including a supporting frame mounted slidably in the front and rear direction, between a drum operating position located within the housing of the electrostatic copying apparatus and a pull-out position forwardly of the housing, and a photosensitive member disposed on the peripheral surface of a rotating drum rotatably mounted on the support frame, said cleaning device comprising:

a cleaning device supporting frame mounted on the support frame, a blade holding mechanism mounted on the cleaning device supporting frame for free pivotal movement around an axis extending substantially parallel to the rotating axis of the rotating drum, a cleaning blade mounted on the blade holding mechanism, blade-holding spring means interposed between the cleaning device supporting frame and the blade holding mechanism for elastically biasing the blade holding mechanism to a non-operating blade position in which the cleaning blade is away from the surface of the photosensitive member, an operating source disposed at a predetermined position within the housing and adapted to be selectively kept in an operating condition and a non-operating condition, and a power transmission arrangement between the operating source and the blade holding mechanism which, when the operating source is kept in the operating condition, selectively holds the blade holding mechanism against the elastic biasing action of the blade-holding spring means at a blade operating position in which the cleaning blade is pressed against the surface of the photosensitive member, said power transmission arrangement including a first power transmission member having an input terminal and an output terminal, said operating source acting on said first power transmission member input terminal, said power transmission arrangement further including a second power transmission member having an input terminal and an output terminal, said second power transmission member output terminal acting on the blade holding mechanism, said power transmission arrangement additionally including means pivotally mounting said first power transmission member at a predetermined position within the housing, means mounting said second power transmission member movably in a predetermined direction and pivotally on the cleaning device supporting frame, and second spring means for elastically biasing the second power transmission member with a larger elastic biasing force than the blade-holding spring means in said predetermined direction and in a direction in which the output terminal of the second power transmission member acts to hold the blade holding mechanism in said blade operating position, whereby when the support frame is held at the drum operating position, the input terminal of the second power transmission member is positioned in cooperating relation to the output terminal of the first power transmisison member and when the operating source is set in said operating condition from said non-operating condition, the first power transmission member is pivoted and by the action of the output terminal of the first power transmission member on the input terminal of the second power transmission member, the second power transmission member is pivoted to cause the output terminal of the second power transmission member to act on the blade holding mechanism to hold it in said blade operating position, and simultaneously the second power transmission member is moved against the elastic biasing action of the second spring means and the cleaning blade is pressed against the surface of the photosensitive member by the elastic force of the second spring means.

7. The cleaning deivce of claim 6 wherein, when the support frame is pulled out to the pull-out position, the cleaning device supporting frame can be pivoted about an axis substantially parallel to the rotating axis of the rotating drum in a direction in which the cleaning blade moves away from the surface of the photosensitive member.

* * * * *